US007129626B2

(12) United States Patent
Kastalsky et al.

(10) Patent No.: US 7,129,626 B2
(45) Date of Patent: Oct. 31, 2006

(54) PIXEL STRUCTURE FOR AN EDGE-EMITTER FIELD-EMISSION DISPLAY

(75) Inventors: Alexander Kastalsky, Wayside, NJ (US); Sergey Shokhor, Sound Beach, NY (US); Frank J. DiSanto, North Hills, NY (US); Denis A. Krusos, Lloyd Harbor, NY (US); Boris Gorfinkel, Saratov (RU); Nikolai Abanshin, Saratov (RU)

(73) Assignee: Copytele, Inc., Melville, NY (US)

( * ) Notice: Subject to any disclaimer, the term of this patent is extended or adjusted under 35 U.S.C. 154(b) by 74 days.

(21) Appl. No.: 10/102,472

(22) Filed: Mar. 20, 2002

(65) Prior Publication Data

US 2002/0134978 A1 Sep. 26, 2002

Related U.S. Application Data

(60) Provisional application No. 60/277,290, filed on Mar. 20, 2001.

(51) Int. Cl.
*H01J 1/02* (2006.01)
*H01J 9/02* (2006.01)

(52) U.S. Cl. ..... 313/309; 313/310; 313/336; 313/351; 313/495; 313/497; 313/422; 313/494; 313/496; 257/10; 257/E51.038

(58) Field of Classification Search ..... 313/309, 313/422, 336, 351, 355, 346, 495–497, 310; 399/128; 257/10
See application file for complete search history.

(56) References Cited

U.S. PATENT DOCUMENTS

| | | | | | |
|---|---|---|---|---|---|
| 3,755,704 | A | | 8/1973 | Spindt et al. | 313/309 |
| 5,214,347 | A | | 5/1993 | Gray | 313/355 |
| 5,345,141 | A | | 9/1994 | Moyer et al. | 313/495 |
| 5,955,850 | A | * | 9/1999 | Yamaguchi et al. | 315/495 |
| 6,023,126 | A | * | 2/2000 | Karpov | 313/310 |
| 6,590,320 | B1 | * | 7/2003 | Abanshin et al. | 313/309 |
| 2003/0090190 | A1 | * | 5/2003 | Takai et al. | 313/311 |

OTHER PUBLICATIONS

"This CRT Flat–Panel–Display Construction and Operating characteristics", C.J. Spindt et al., SID–98, pp. 99–102.
"A Thin–Film Field–Emission Cathode", C.A. Spindt, Journal of Applied Physics, vol. 39, #7, Jun. 1968, pp. 3504–3505.

* cited by examiner

*Primary Examiner*—Kenneth Parker
*Assistant Examiner*—Joseph Nguyen
(74) *Attorney, Agent, or Firm*—Plevy, Howard & Darcy, PC

(57) ABSTRACT

A pixel structure and an edge-emitter field-emission display device having a first substrate or backplate including a cathode disposed thereon and a second substrate or faceplate including an anode disposed thereon, wherein the anode on the second substrate or faceplate has a light emitting film. The cathode may define a first bus of an X-Y bus array and the anode may define a second bus of the X-Y bus array. Alternatively, the first substrate may further include a control gate disposed thereon, wherein the cathode defines a first bus of an X-Y bus array and the control gate defines a second bus of the X-Y bus array.

20 Claims, 2 Drawing Sheets

PIXEL STRUCTURE FOR AN EDGE-EMITTER FIELD-EMISSION DISPLAY

PRIORITY FILING DATE

This application claims the benefit of the earlier filing date, under 35 U.S.C. §119, of U.S. Provisional Patent Application:

Ser. No. 60/277,290 entitled "Pixel Structure for an Edge-Emitter Field Emission Display," filed on Mar. 20, 2001, which is incorporated by reference herein.

RELATED APPLICATIONS

This application relates to commonly assigned, copending U.S. patent applications:

Ser. No. 09/511,437 entitled, "Thin-Film Planar Edge-Emitter Field Emission Flat Panel Display," filed on Feb. 23, 2000;

Ser. No. 10/102,467 entitled "Field-Emission Matrix Display Based on Lateral Electron Reflection," filed on Mar. 20, 2002, which subsequently issued as U.S. Pat. No. 6,614,149; and Ser. No. 10/102,450 entitled "Field-Emission Matrix Display Based on Electron Reflection;" filed on Mar. 20, 2002,

FIELD OF THE INVENTION

This invention relates to flat panel displays (FPD), and in particular, to pixel structures for an edge-emitter field-emission flat panel display having a light emitting film disposed on the faceplate of the display.

BACKGROUND OF THE INVENTION

Flat panel display (FPD) technology is one of the fastest growing technologies in the world with a potential to surpass and replace Cathode Ray Tubes in the foreseeable future. As a result of this growth, a large variety of the FPDs, ranging from very small virtual reality eye tools to large TV-on-the wall displays, with digital signal processing and high-definition screen resolution, will become available.

Some of the more important requirements of FPDs are video rate of the signal processing (moving picture); resolution typically above 100 DPI (dots per inch); color; contrast ratios greater than 20; flat panel geometry; screen brightness above 100cd/m$^2$; and large viewing angle.

At present, liquid crystal displays (LCD) dominate the FPD market. However, although tremendous technological progress has been made in recent years, LCDs still have some drawbacks and limitations that pose significant restraints on the entire industry. First, LCD technology is rather complex, which results in a high manufacturing cost and price of the product. Other deficiencies, such as small viewing angle, low brightness and relatively narrow temperature range of operation, make application of the LCDs difficult in many high market value areas, such as car navigation devices, car computers, and mini-displays for cellular phones.

Other FPD technologies capable of competing with the LCDs, are currently under intense investigation. Among these technologies, plasma displays and field-emission displays (FED) are considered the most promising. Plasma displays employ a plasma discharge in each pixel to produce light. One limitation associated with plasma displays is that the pixel cells for plasma discharge cannot be made very small without affecting neighboring pixel cells. This is why the resolution in a plasma FPD is poor for small format displays but becomes efficient as the display size increases above 30" diagonally. Another limitation associated with plasma displays is that they tend to be thick. A typical plasma display has a thickness of about 4 inches.

FEDs employ "cold cathodes" which produce mini-electron beams that activate phosphor layers in the pixel. It has been predicted that FEDs will replace LCDs in the future. Currently, many companies are involved in FED development. However, after ten years effort, FEDs are not yet in the market.

FED mass production has been delayed for several reasons. One of these reasons concerns the fabrication the electron emitters. The traditional emitter fabrication is based on forming multiple metal (Molybdenum) tips, see C. A. Spindt "Thin-film Field Emission Cathode", Journ. Of Appl. Phys, v. 39, 3504, and U.S. Pat. No. 3,755,704 issued to C. A. Spindt. The metal tips concentrate an electric field, activating a field induced auto-electron emission to a positively biased anode. The anode contains light emitting phosphors which produce an image when struck by an emitted electron. The technology for fabricating the metal tips, together with necessary controlling gates, is rather complex. In particular, fabrication requires a sub-micron, e-beam, lithography and angled metal deposition in a large base e-beam evaporator.

Another difficulty associated with FED mass production relates to life time of FEDs. The electron strike of the phosphors results in phosphor molecule dissociation and formation of gases, such as sulfur oxide and oxygen, in the vacuum chamber. The gas molecules reaching the tips screen the electric field resulting in a reduction of the efficiency of electron emission from the tips. A second group of gases, produced by electron bombardment, contaminates the phosphor surface and forms undesirable energy band bending at the phosphor surface. This prevents electron-hole diffusion from the surface into the depth of the phosphor grain resulting in a reduction of the light radiation component of electron-hole recombination from the phosphor. These gas formation processes are interrelated and directly connected with vacuum degradation in the display chamber.

The gas formation processes are most active in the intermediate anode voltage range of 200–1000V. If, however, the voltage is elevated to 6–10 kV, the incoming electrons penetrate deeply into the phosphor grain. In this case, the products of phosphor dissociation are sealed inside the grain and cannot escape into the vacuum. This significantly increases the life time of the FED and makes it close to that of a conventional cathode ray tube.

The high anode voltage approach is currently accepted by all FED developers. This, however, creates another problem. To apply such a high voltage, the anode must be made on a separate substrate and removed from the emitter a significant distance equaling about 1 mm. Under these conditions, the gate controlling efficiency decreases, and pixel cross-talk becomes a noticeable factor. To prevent this effect, an additional electron beam focusing grid is introduced between the first grid and the anode, see e.g. C. J. Spindt, et al. "Thin CRT Flat-Panel-Display Construction and Operating Characteristics", SID-98 Digest, p. 99, which further complicates display fabrication.

Some existing tip-based pixel FEDs include an additional electron beam focusing grid. Such FEDs include an anode, a cathode having a plurality of metal tip-like emitters, and a control gate made as a film with small holes above the tips of the emitters. The emitter tips produce mini-electron beams that activate phosphors contained by the anode. The phosphors are coated with a thin film of aluminum. The metal tip-like emitters and holes in the controlling gate, which are less than 1 μm in diameter, are expensive and time consuming to manufacture, hence they are not readily suited for mass production.

Another approach to FED emitter fabrication involves forming the emitter in the shape of a sharp edge to concentrate the electric field. See U.S. Pat. No. 5,214,347 entitled "Layered Thin-Edge Field Emitter Device" issued to H. F. Gray. The emitter described in this patent is a three-terminal device for operation at 200V and above. The emitter employs a metal film the edge of which operates as an emitter. The anode electrode is fabricated on the same substrate, and is oriented normally to the substrate plane, making it unsuitable for display functions. A remote anode electrode is provided parallel to the substrate, making it suitable for the display purposes. The anode electrode, however, requires a second plate which significantly complicates the fabrication of the display.

Still another approach to FED emitter fabrication can be found in U.S. Pat. No. 5,345,141, entitled "Single Substrate Vacuum Fluorescent Display", issued to C. D. Moyer et al. which relates to the edge-emitting FED.

The pixel structures described in U.S. Pat. No. 5,345,141 include a diamond film deposited on top of a metal film and only the diamond edge is exposed. Thus, only a relatively small fringing electric field coming from the metal film underneath the diamond film contributes to the field emission process.

Another limitation of this emitter is that the emitter films, including the diamond film and the insulator film, are grown on a phosphor film. The phosphor film is known to have a very rough surface morphology that makes it unsuitable for any further film deposition. A further limitation of this structure relates to its poor emission efficiency which is due to the phosphor layers on both sides of the emitter. At the anode side, the electric field is concentrated at the phosphor film edge and the emitted electrons reaching the phosphor will strike mostly an opposing edge, such that phosphor activation occurs on the side of the phosphor pad.

More recent FED pixel structures, which place the emitting film close to the emitters, typically have problems with shorts or pixel leakage. Additionally, these more recent designs have X and Y metal bus arrangements that place one of the two buses across deep wells, which can lead to the metal line breaks.

Accordingly, there is a need for a FED pixel design which substantially eliminates the problems associated with FED fabrication and allows for mass production of FEDs.

SUMMARY OF THE INVENTION

According to a first aspect of the invention, a pixel structure for a field-emission display device comprises a first substrate including a cathode disposed thereon and a second substrate including an anode disposed thereon, wherein the anode has a light emitting film. The cathode may define a first bus of an X-Y bus array and the anode may define a second bus of the X-Y bus array. Alternatively, the first substrate may further include a control gate disposed thereon, wherein the cathode defines a first bus of an X-Y bus array and the control gate defines a second bus of the X-Y bus array.

According to a second aspect of the invention, a field-emission display device comprises a backplate including a cathode disposed thereon and a faceplate including an anode disposed thereon, wherein the anode has a light emitting film. The cathode may define a first bus of an X-Y bus array and the anode may define a second bus of the X-Y bus array. Alternatively, the backplate may further include a control gate disposed thereon, wherein the cathode defines a first bus of an X-Y bus array and the control gate defines a second bus of the X-Y bus array.

BRIEF DESCRIPTION OF THE DRAWINGS

The advantages, nature, and various additional features of the invention will appear more fully upon consideration of the illustrative embodiments now to be described in detail wherein.

Figure 1:
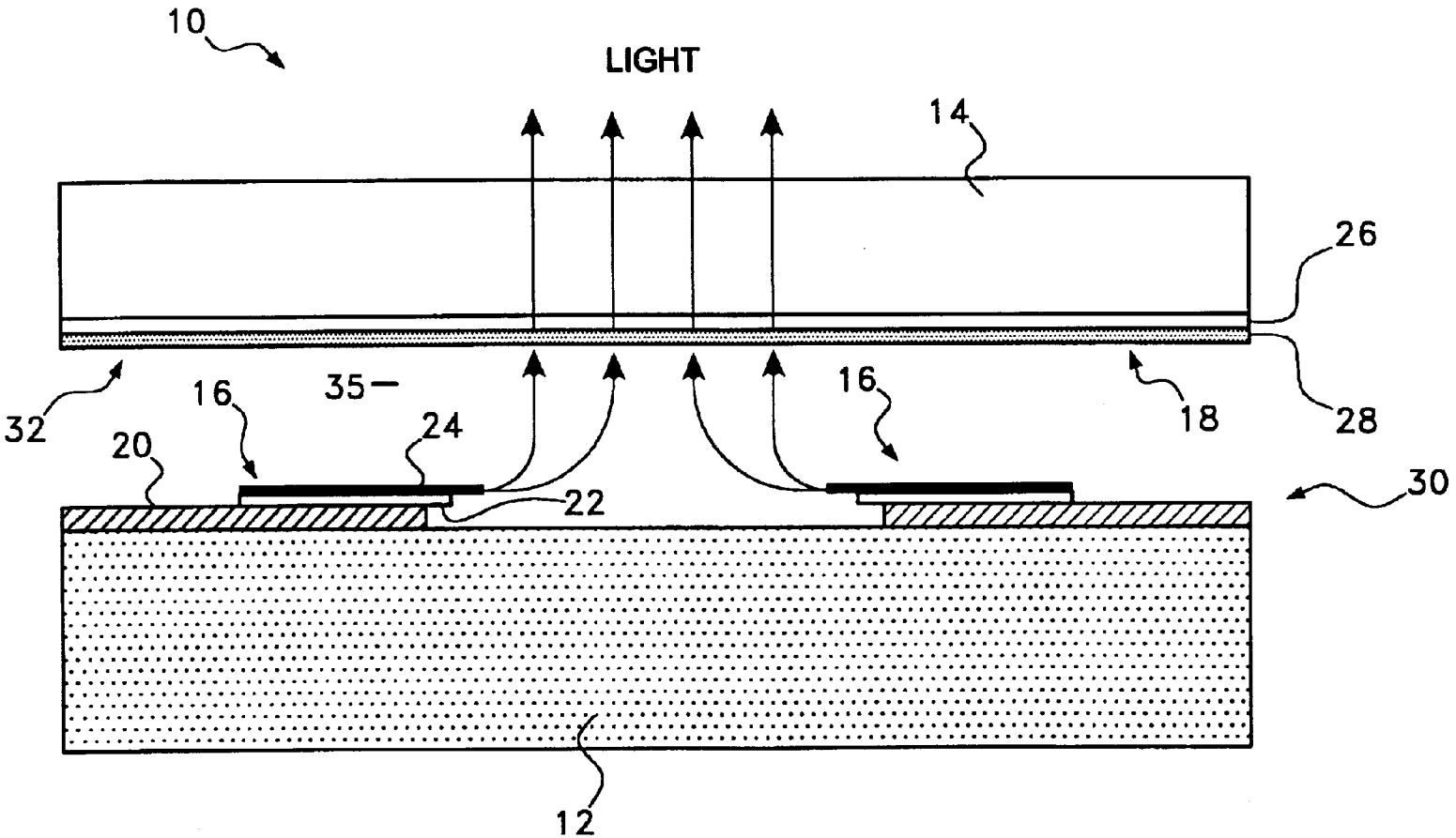
FIG. 1 illustrates a pixel structure of an edge emitter field-emission-display according to a first embodiment of the present invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

FIG. 1 illustrates an exemplary pixel structure 10 for an edge-emitter field-emission display (FED) according to a first embodiment of the present invention. The pixel structure 10 of this embodiment of the invention is constructed with two-terminal control elements; a cathode 16 formed on a first substrate 12 or backplate and an anode 18 formed on a second transparent substrate or faceplate 14. Anode 18 is positioned parallel to and spaced from the first substrate 12.

Cathode 16 is typically formed by a triple layer structure comprised of a conductive film 20, an insulative film 22, and a thin conductive emitter film 24. In one exemplary embodiment, the conductive film 20 may be made from a material such as molybdenum (Mo), insulative film 22 may be made from a resistive material, such as α-Si, and the thin conductive emitter film 24 may be made from a material such as α-carbon. Films 20, 22, 24 can be deposited or otherwise formed on the first substrate 12 using conventional thin film deposition techniques. Films 20, 22, 24 may further be conventionally patterned into a plurality of lines that extend normal to the plane of FIG. 1 and define a first bus array 30 (Y bus) of a matrix of pixel elements.

Anode 18 is typically formed by a double layer structure of a transparent conductive film 26 such as Indium Tin Oxide (ITO), followed by a light emitting film 28 such as phosphor. Films 26, 28 can be deposited or otherwise formed on the second substrate 14, such as a glass, using conventional thin film deposition techniques. Films 26, 28 may then be conventionally patterned into a plurality of lines that extend horizontally in the plane of FIG. 1 and define a second bus array 32 (X bus) of the pixel matrix. Each intersecting X and Y bus forms a pixel 35 in a matrix of pixel elements, of which only one is illustrated.

The spatial separation between the crossing X-Y bus arrays 32, 30 is advantageous as it simplifies display processing and increases manufacturing yields as compared with conventional FEDs that place the Y and X buses on a common substrate. The placement of X and Y buses on a common substrate requires that one of the buses be deposited across pixel wells that are typically 4 μm deep. Such deposition techniques complicate display processing and reduce manufacturing yields. Placing one of the buses on the faceplate as in the present invention advantageously eliminates the deposition of a bus across pixel wells.

The light emitting film 28 deposited on the faceplate 14 emits light at the intersections of the X-Y bus arrays 32, 30 under electron bombardment. Electron emission and bombardment of the phosphor layer occurs when a positive voltage is applied to the Y bus 32 relative to the X bus 30. In this case, free electrons at the edge of conductive emitter film 24 are attracted to ITO layer 32.

Using a value for the carbon film electron efficiency of 10 V/μm (indicating the threshold of the field emission) a voltage in the range of approximately 500–600V can be obtained for a vacuum separation between the substrates of, preferably between 20–30 μm. In one aspect of the invention, the applied voltage can be subdivided into a constant "pedestal" component of between 400–500 volts and a variable voltage component of 100 volts controlled by a driving circuit (not shown). Thus, relatively inexpensive, low voltage drivers can be employed in a FED that employs the diode pixel structure 10 of the present invention.

In one aspect, the preferred 20–30 μm separation may be provided by spacers (not shown) disposed between the first and second substrates 12, 14. The use of spacers allows the substrate thickness to be reduced to provide an FED that is in the range of 2–3 mm thick. In addition, the preferred substrate separation ensures the absence of any pixel cross-talk due to electron emission spread.

Figure 2:
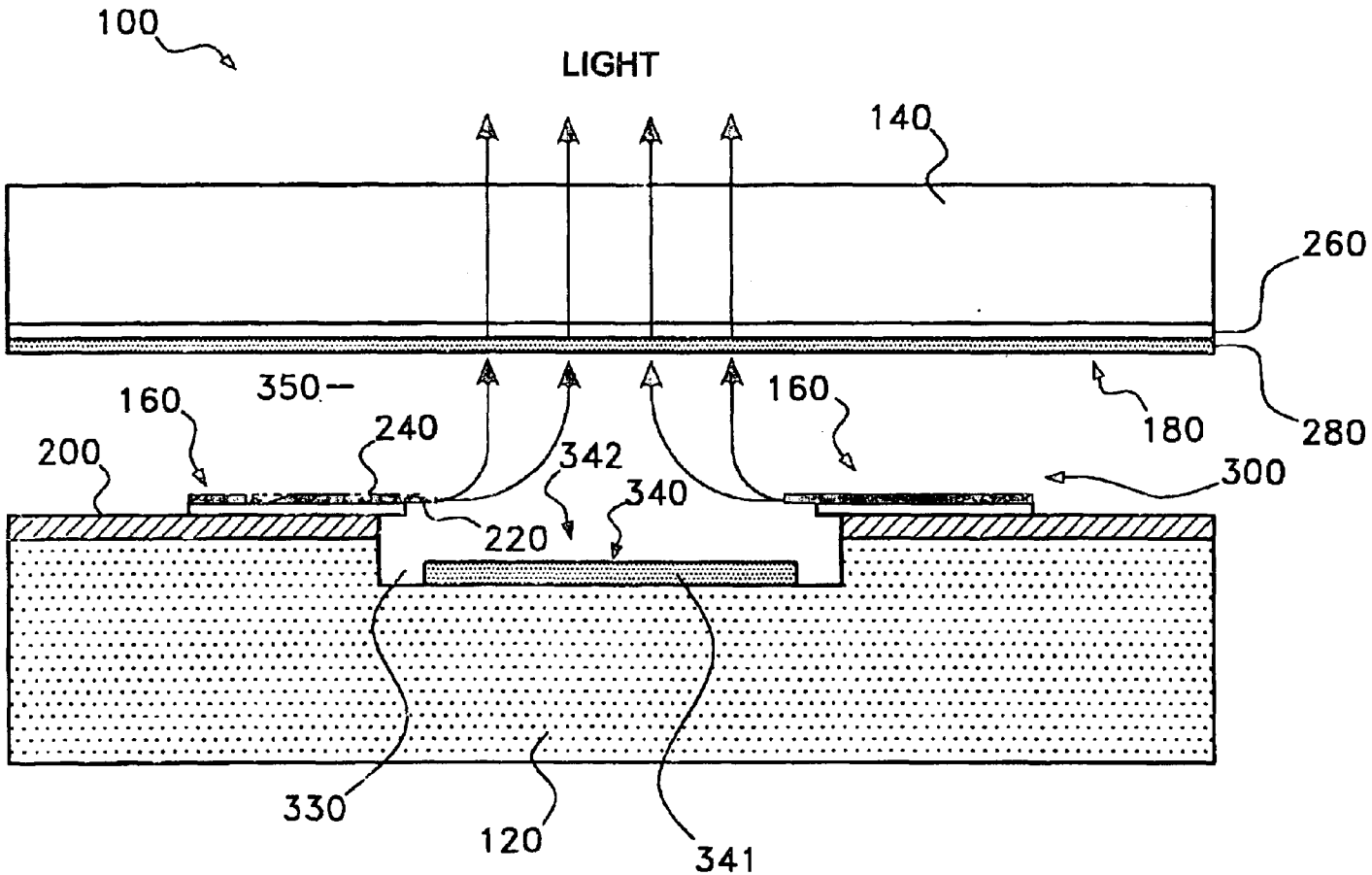
FIG. 2 illustrates a pixel structure of an edge emitter field-emission-display according to a second embodiment of the present invention.

FIG. 2 illustrates a pixel structure 100 for an edge-emitter FED according to a second exemplary embodiment of the present invention. The pixel structure 100 of this embodiment of the invention is constructed with three-terminal elements; a cathode 160 and a control gate 340 formed on a first substrate 120 or backplate, and an anode 180 formed on a second transparent substrate or faceplate 140. As previously discussed, anode 180 is positioned parallel to and spaced from the first substrate 120.

Anode 180 is substantially identical to the anode of the first embodiment in that it is formed by a double layer structure of a transparent conductive film 260 such as ITO, followed by a light emitting film 280 such as phosphor. However, films 260, 280 in this second embodiment form a continuous electrode rather than a plurality of lines as in the first embodiment.

Cathode 160 is substantially identical to the cathode disclosed in the first embodiment, and therefore, comprises the same triple layer structure described previously, which is patterned into a plurality of lines that extend horizontal in the plane of FIG. 2 and define a first bus array 300 (X bus) of a matrix of pixel elements. Control gate 340 is typically formed as a plurality of conductive lines 341, formed from a conductive film, that extend normal to the plane of FIG. 2. Conductive lines 341 are deposited or otherwise formed in wells 330 on the first substrate 120 using conventional thin film deposition techniques. Only one control gate/well is depicted in FIG. 2. The conductive film that forms the control gate 340 may be made, for example from Mo or any other suitable conductive material. The conductive lines 341 which form the control gate 340 define a second bus array 342 (Y bus) of the pixel matrix. Each intersecting X and Y bus forms a pixel 350 in the pixel matrix of which only one pixel element is shown. Control gate 340 operates to control the field emission current to the anode 180 formed on face plate 140.

In operation, when a high constant voltage is applied to anode 180 relative to the cathode 160, free electrons from cathode 160 are drawn to anode 180 when the voltage on control gate 340 is zero or relatively low. The drawn electrons activate the light emitting film 280 of the anode 180. In this case, pixel 350 in an "on" state. If, however, a negative voltage is applied to the control gate 340, the total electric field at the cathode edge is reduced and the emission current is suppressed, In this case, pixel 350 in an "off" state. To enhance the gate modulation efficiency, the conductive layer of the control gate 340 can be placed very close to the thin conductive emitter film 240 of the cathode 160, i.e., within about 1 μm. The 1 μm distance yields a controlling voltage of 10–20V.

The pixel structure 100 of the second embodiment requires relatively shallow wells 330 of about 1–1.5 μm for the Y buses 342 and therefore minimizes the problem of placing the X buses 300 across the wells 330 (not shown). The low voltage needed for current modulation in this pixel structure simplifies the requisite driving circuit (not shown). This in turn, reduces the display cost.

While the foregoing invention has been described with reference to the above embodiments, various modifications and changes can be made without departing from the spirit of the invention. Accordingly, all such modifications and changes are considered to be within the scope of the appended claims.

What is claimed is:

1. An X-Y bus line array addressable field-emission display device comprising:

a substrate including a plurality of wells therein;

a cathode disposed on said substrate, patterned into one of said X and Y bus lines, and comprising: an alpha-Carbon material containing emitter layer having an edge electrically isolated from a conductive layer and extending over a corresponding one of said wells, a second substrate including an anode disposed thereon, oppositely positioned and electrically isolated from said first substrate; and a light emitting film deposited on said anode.

2. The device according to claim 1, wherein the anode is patterned into the other of said X and Y bus lines of the X-Y bus array.

3. The device according to claim 1, wherein the X-Y bus array defines a plurality of intersections, each of the intersections operating as a pixel of said field-emission display device.

4. The device according to claim 1, wherein the first substrate futher includes a control gate patterned into the other of said X and Y bus lines and disposed within said wells.

5. The device according to claim 4, wherein the control gate controls a field emission current applied to the anode.

6. The device according to claim 4, wherein the anode defines a continuous electrode.

7. The device according to claim 4, wherein the X-Y bus array defines a plurality of intersections, each of the intersections forming a pixel of said field-emission display device.

8. A bus array addressable field-emission display device comprising:

a backplate including a plurality of wells therein;

a cathode patterned into a first bus of the bus array disposed on said backplate, wherein said cathode comprises an alpha-Carbon material containing emitter layer having an edge electrically isolated from a conductive layer and extending over a corresponding one of said wells, a faceplate including an anode disposed thereon, oppositely positioned to and electrically isolated from said backplate; and a light emitting film on said anode.

9. The field-emission display device according to claim 8, wherein the anode is patterned into a second bus of the bus array, the bus array forming a pixel matrix.

10. The field-emission display device according to claim 8, wherein the backplate further includes a control gate disposed within said wells, the control gate defines a second bus of the bus array, and the bus array forming a pixel matrix.

11. The field-emission display device according to claim 10, wherein the control gate controls a field emission current applied to the anode.

12. The field-emission display device according to claim 10, wherein the anode defines a continuous electrode.

13. A bus addressable field emission display device comprising:

a cathode comprising: a first substrate supporting a first of two conductive buses, an insulator layer and an emitter layer, wherein said first bus and emitter layer are electrically insulated from one-another by said insulator layer, said first conductive bus includes at least one aperture at least partially defining a well and said insulator and emitter layer each has at least one edge laterally extending over said well; and, an anode comprising a second substrate supporting the second of the two conductive buses and a light emitting film;

wherein, each intersection of the conductive buses defines an addressable pixel of said field emission display device.

14. The device of claim 13, wherein said emitter comprises an alpha-Carbon material.

15. A bus addressable field emission display device comprising:

a cathode comprising: a first substrate supporting a first conductive bus, an insulator layer and an emitter layer, wherein said first bus and emitter layer are electrically insulated from one-another by said insulator layer, said first conductive bus includes at least one aperture at least partially defining a well and said emitter layer has at least one edge laterally extending over said well;

an anode comprising a second substrate supporting a light emitting film; and, a control gate electrode comprising a second conductive bus being supported by said first substrate in said well, proximate to said emitter and distal from said light emitting film;

wherein, each intersection of the conductive buses defines an addressable pixel of said field emission display device.

16. The device of claim 15, wherein said emitter comprises an alpha-Carbon material.

17. A bus array addressable field-emission display device comprising:

a backplate having a plurality of wells therein;

a cathode disposed on said backplate, patterned into a first bus of the bus array and comprising an emitter having an edge extending over at least one of said wells;

at least one insulator having an edge extending over at least one of said wells and electrically insulating said first bus from said emitter;

a faceplate including an anode disposed thereon, oppositely positioned to and electrically isolated from said backplate and patterned into a second bus of the bus array; and a light emitting film on said anode;

wherein, each intersection of said first and second buses is an addressable pixel of said field emission display device.

18. The device of claim 17, wherein said emitter comprises an alpha-Carbon material.

19. A bus array addressable field-emission display device comprising:

a backplate including a plurality of wells therein;

a cathode disposed on said backplate, patterned into a first bus of the bus array and comprising an emitter having an edge extending over at least one of said wells;

at least one insulator layer electrically insulating said first bus from said emitter;

a faceplate including an anode disposed thereon, oppositely positioned to and electrically isolated from said backplate;

a light emitting film on said anode; and, at least one control gate disposed in at least one of said wells substantially proximate to said emitting layer and distal from said light emitting film;

wherein, each intersection of said first bus lines and control gate is an addressable pixel of said field emission display device.

20. The device of claim 19, wherein said emitter comprises an alpha-Carbon material.

* * * * *

UNITED STATES PATENT AND TRADEMARK OFFICE

CERTIFICATE OF CORRECTION

PATENT NO. : 7,129,626 B2
APPLICATION NO. : 10/102472
DATED : October 31, 2006
INVENTOR(S) : Alexander Kastalsky et al.

It is certified that error appears in the above-identified patent and that said Letters Patent is hereby corrected as shown below:

Line 3 of Claim 1 Col. 6, Line 30 should read: --a first substrate including a plurality of wells therein;--

Signed and Sealed this

Twenty-seventh Day of February, 2007

JON W. DUDAS
*Director of the United States Patent and Trademark Office*